US007080810B2

(12) United States Patent
Munjed

(10) Patent No.: US 7,080,810 B2
(45) Date of Patent: Jul. 25, 2006

(54) APPARATUS AND METHOD FOR FEEDING AN INFANT

(76) Inventor: Mary A. Munjed, 677 Blenheim Loop, Winter Springs, FL (US) 32708

( * ) Notice: Subject to any disclaimer, the term of this patent is extended or adjusted under 35 U.S.C. 154(b) by 126 days.

(21) Appl. No.: 10/785,656

(22) Filed: Feb. 24, 2004

(65) Prior Publication Data

US 2005/0184023 A1 Aug. 25, 2005

(51) Int. Cl.
*A61J 9/06* (2006.01)

(52) U.S. Cl. ..... 248/102; 248/106; 248/910

(58) Field of Classification Search ..... 248/102, 248/103, 104, 105, 106, 107, 910; 215/11.6
See application file for complete search history.

(56) References Cited

U.S. PATENT DOCUMENTS

| | | | | | |
|---|---|---|---|---|---|
| 1,859,123 | A | | 5/1932 | Ballert | |
| D141,700 | S | | 6/1945 | Rapor | |
| D153,937 | S | | 5/1949 | Graboi | |
| 2,475,923 | A | * | 7/1949 | Suich | 248/105 |
| D160,192 | S | | 2/1950 | Miller | |
| 2,711,052 | A | | 6/1955 | Brayford | |
| 3,905,571 | A | | 9/1975 | Lombardo | |
| 4,162,696 | A | * | 7/1979 | Sprung | 206/316.2 |
| 4,788,916 | A | * | 12/1988 | Saxton | 108/43 |
| 4,895,327 | A | * | 1/1990 | Malone et al. | 248/102 |
| 4,953,816 | A | | 9/1990 | Wilkinson | |
| D314,432 | S | | 2/1991 | Shaw | |
| 5,022,616 | A | * | 6/1991 | Kordecki | 248/106 |
| 5,072,843 | A | | 12/1991 | James | |
| 5,184,796 | A | * | 2/1993 | Maher | 248/104 |
| 5,217,192 | A | | 6/1993 | Oktayuren | |
| 5,624,090 | A | | 4/1997 | Gammelgaard | |
| 5,820,084 | A | * | 10/1998 | Trumbauer et al. | 248/102 |
| 5,871,184 | A | | 2/1999 | Kaopio | |
| D412,583 | S | | 8/1999 | Miller | |
| 5,979,843 | A | * | 11/1999 | Beck | 248/102 |
| 6,082,681 | A | | 7/2000 | Rand | |
| 6,098,934 | A | * | 8/2000 | Skelton | 248/102 |
| D432,759 | S | | 10/2000 | Krolczyk et al. | |
| 6,581,888 | B1 | * | 6/2003 | Castillo | 248/146 |
| 6,592,084 | B1 | * | 7/2003 | Nile | 248/104 |
| 6,641,094 | B1 | | 11/2003 | Fishler | |
| 2005/0103954 | A1 | * | 5/2005 | Touma | 248/103 |

* cited by examiner

*Primary Examiner*—Ramon O Ramirez
(74) *Attorney, Agent, or Firm*—Robert L. Wolter, Esquire; Beusse Wolter Sanks Mora & Maire, P.A.

(57) ABSTRACT

An apparatus for feeding an infant provides a bottle holder operatively connected to a weighted conformable support member that rests on the torso of an infant. The support member conforms to the contours of the infant's body and is sufficiently heavy to prevent the infant from tossing the apparatus aside. In an exemplary, the bottle holder comprises two resilient grasping members that extend upwardly from the support member. The grasping members are tall enough so the elevation and tilt of the bottle, with respect to an infant can be adjusted to an appropriate feeding position for the infant.

16 Claims, 3 Drawing Sheets

APPARATUS AND METHOD FOR FEEDING AN INFANT

The present invention relates generally to systems and methods for feeding infants using bottles. More specifically, the invention pertains to systems and methods that incorporate a bottle holder that enables an infant to feed without the assistance of a caregiver.

Such systems typically include a support member that rests on the infant or the seat in which the infant is sitting. A holder or grasping member is operatively connected to the support member, and holds a bottle within reach of an infant. The support members are often lightweight stuffed toys that rest on the infant's lap; however, given the lightweight nature of the support member, an infant is able to toss the support member from his/her lap. Accordingly, some systems include straps to secure the bottle holder to a seat or the child, which can complicate assembly of the system. In addition, other systems hold the bottle in a rigid position and limit movement of the bottle to different feeding positions for the infant.

SUMMARY OF THE INVENTION

The present invention for an apparatus and method for feeding an infant provides a bottle holder operatively connected to a weighted conformable support member that rests on the torso of an infant. The support member conforms to the contours of the infant's body and is sufficiently heavy to prevent the infant from tossing the apparatus aside. In an exemplary embodiment, the bottle holder comprises two resilient grasping members that extend upwardly from the support member. The grasping members are tall enough so the elevation and tilt of the bottle, with respect to an infant, can be adjusted to an appropriate feeding position for the infant. When the bottle is secured between the grasping members, and a nipple of the bottle is placed within the infant's mouth, the infant and/or caregiver do not have to handle the bottle. In addition, the bottle holder may be moveable with respect to the support member toward the infant for feeding, and away from the infant for removing the bottle from the infant's mouth.

The support member may comprise a casing that is filled with a weighted compressible filler, which is disposed within the bottom of the casing. An internal frame member includes two prongs that are supported on the weighted filler, and extend upward from the filler. The casing encapsulates the filler and internal frame member. Soft lightweight compressible filler is packed in the casing covering the prongs for safety purposes. The prongs are composed of a resilient material so the bottle can be positioned between the prongs, which apply a frictional force to support the bottle during feeding. The infant or caregiver may also pivot the bottle holder to move the bottle to a desired feeding.

DETAILED DESCRIPTION OF THE INVENTION

Figure 1:
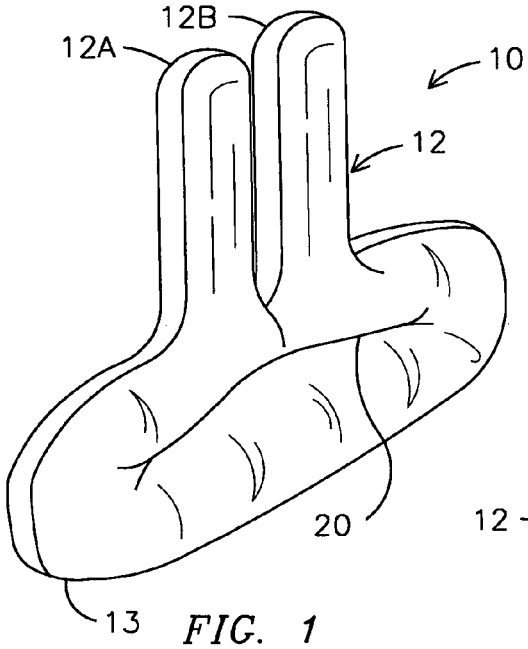
FIG. 1 is a perspective view of the apparatus for feeding an infant.
Figure 2:
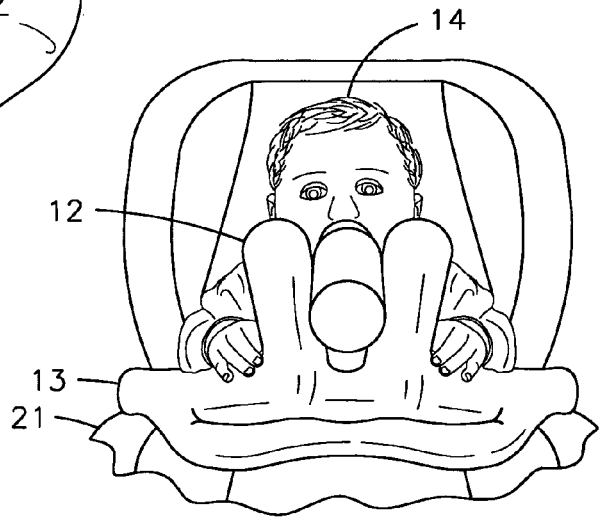
FIG. 2 is a front elevational view of the invention in use feeding an infant.
Figure 3:
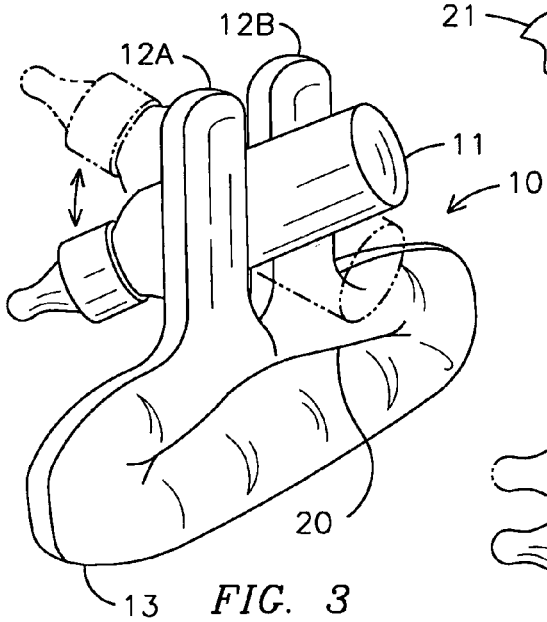
FIG. 3 is a side elevational view with a bottle.
Figure 4:
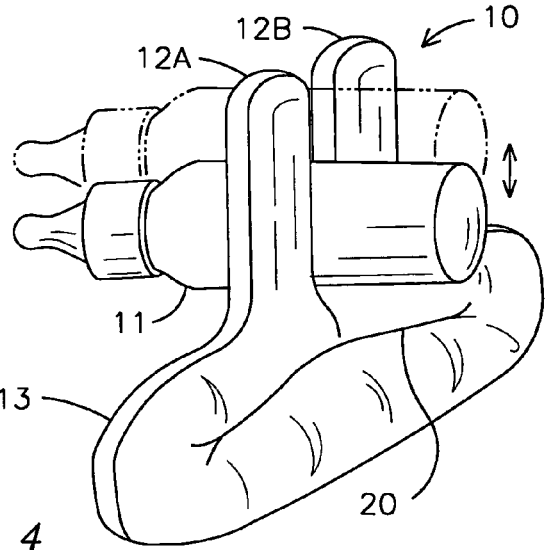
FIG. 4 is a side elevational view with a bottle.

With reference to the figures, and in particular FIGS. 1–4, the system 10 is illustrated and comprises a bottle 11 secured within a holder 12, which is operatively connected to, and extends upwardly from, a weighted support member 13. As shown in FIGS. 3 and 4, the bottle holder 12 is moveable with respect to the support member 13, to move the bottle 11 toward the infant 14 for feeding, or away from the infant's 14 mouth to stop feeding. The exemplary embodiment described and illustrated herein shows the bottle holder 12 moving in a pivotal motion with respect to the support member 13; however, other forms of movement are possible depending on the nature of the attachment of the holder 12 to the support member 13.

Figure 5:
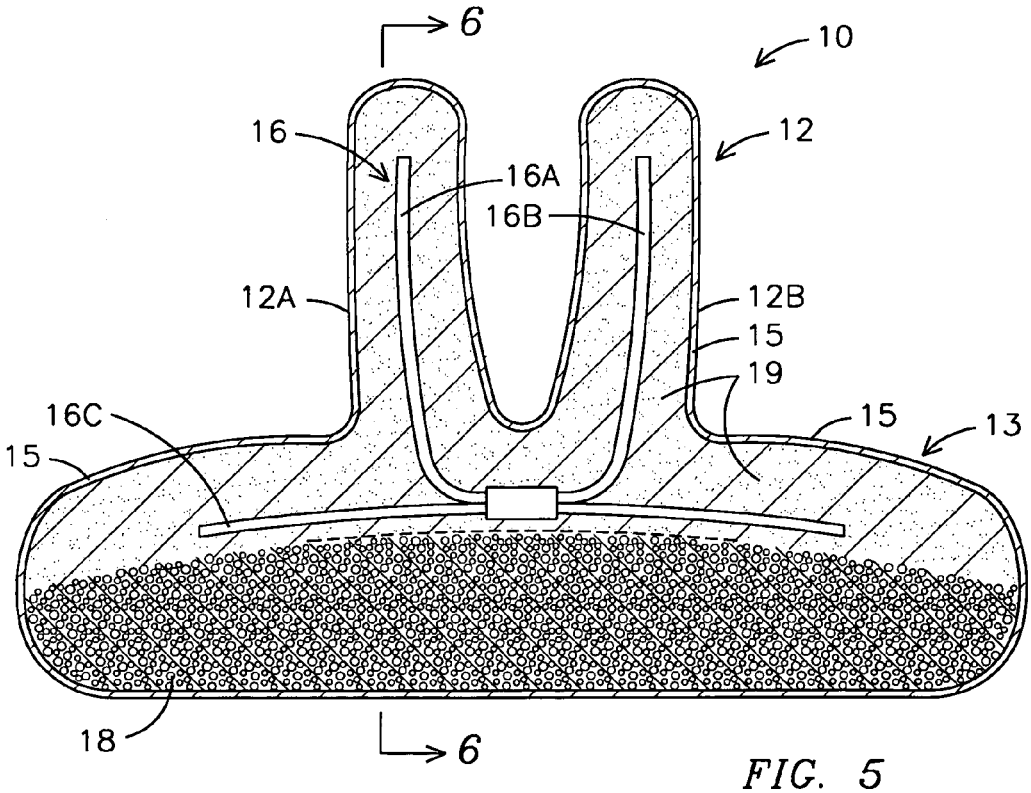
FIG. 5 is a front sectional view taken along lines 5—5 in FIG. 6.
Figure 6:
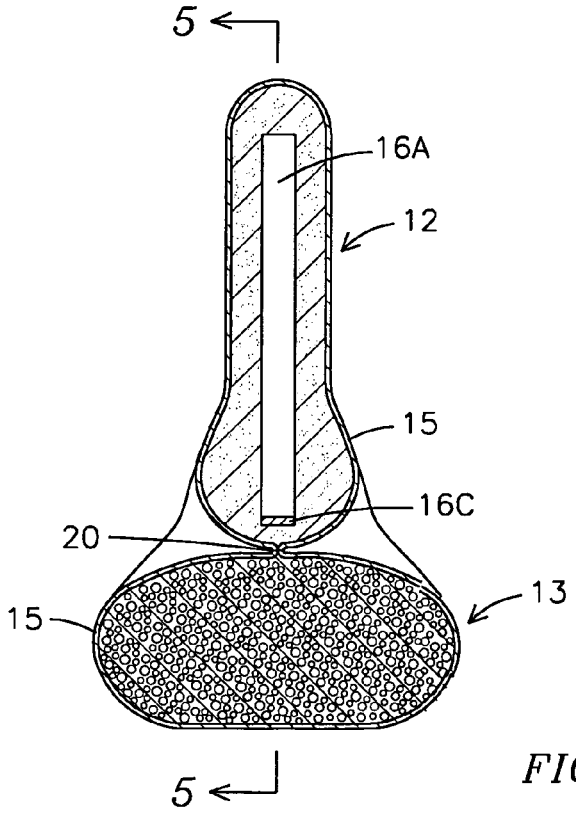
FIG. 6 is a sectional view taken along line 6—6 in FIG. 5.
Figure 7:
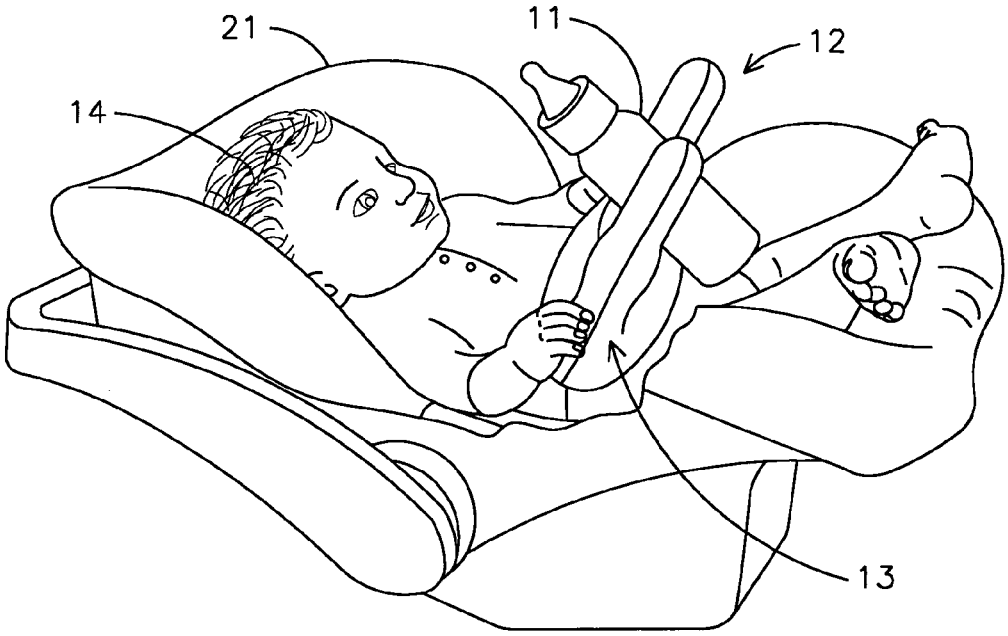
FIG. 7 is a perspective view of the invention when a bottle is removed from an infant's mouth.
Figure 8:
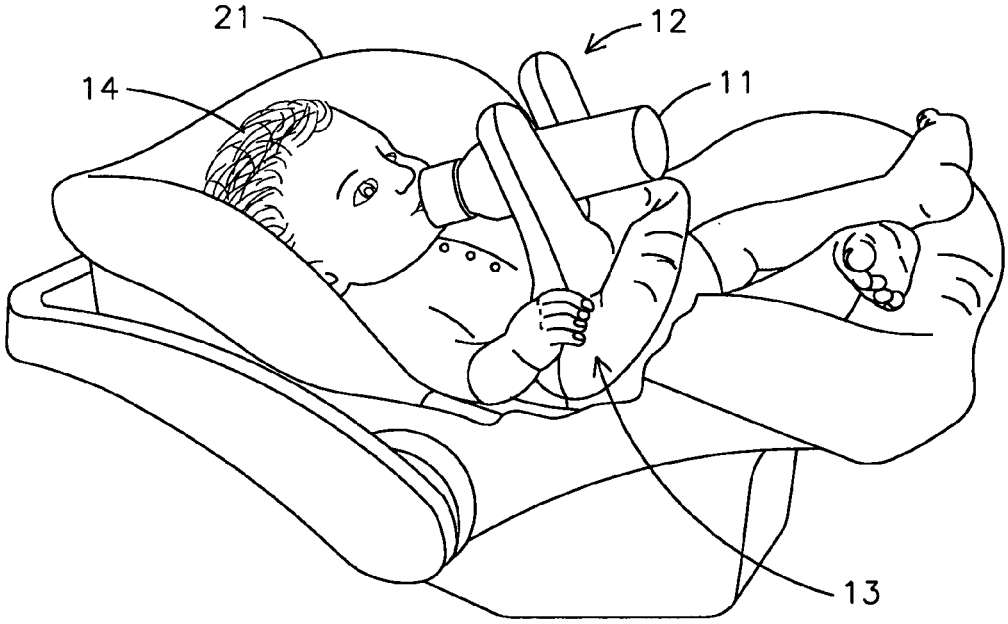
FIG. 8 is a perspective view of the invention in use feeding an infant.

With respect to FIGS. 5–6, an exemplary embodiment of the support member 13 and bottle holder 12 is shown in more detail. The bottle holder 12 and support member 13 have internal components enclosed within a casing 15, so the apparatus 10 is padded, weighted or conformable as necessary for operation of the apparatus.

The support member 13 is weighted and conformable to the contours of the infant's 14 torso as shown in FIG. 2, in order to stabilize the holder 12 and a bottle 11 on the infant 14. The support member 13 comprises a weighted, compressible filler 18 within a bottom 17 of the casing 15. The filler 18 is heavy enough to prevent the infant from moving the support member 13. For example, the support member 13 may weigh about 2½–3 pounds, so the infant cannot move the support member 13, but the support member 13 is not too heavy to make feeding uncomfortable for the child or injure the infant 14. The filler 18 may comprise a pellet-type material so the support member 13 is compressible. Any filler having adequate weight and that is sufficiently soft and compressible may work. For example, the filler 18 may comprise a food product such as rice or beans, but a non-reactive or material minimally subject to decomposition, such as sand or plastic, may be preferred.

The bottle holder 12 shown in FIGS. 3-6 includes two grasping members 12A and 12B that are spaced apart from one another and extend upwardly from, and are operatively connect to the support member 13. The grasping members 12A and 12B are resilient so the members 12A and 12B can be shaped to snugly fit the bottle 11. As shown in FIGS. 3 and 4 the grasping members 12A and 12B are pivotal with respect to the support member 13, so the infant 14 can pull the bottle 11 toward his/her mouth for feeding, or remove the bottle from its mouth.

In an exemplary embodiment, as shown in FIG. 5, the bottle holder 12 and grasping members 12A and 12B may comprise an internal frame member 16 having two prongs 16A and 16B attached to a transverse base member 16C. The prongs 16A and 16B are resilient so the grasping members 12A and 12B can be adjusted to snugly grasp the bottle 11 for feeding, or so the bottle 11 may be removed. For example, the prongs 16A and 16B may include one or more gauge copper wires encased in insulated rubber to prevent the wires from damaging the casing. In a working embodiment, 600 volt insulated underground wires have been formed to work well. Other resilient metals or materials, such as plastics, rubbers, fiberglass etc., may be used that are sufficiently strong to maintain some rigidity to continue to be operable over time.

With respect to FIG. 5, the base member 16C spaced slightly above or rests on the filler 18, and the prongs 16A and 16B are attached to the base member. The casing 15 covers the prongs 16A and 16B, and the base member 16B. A lightweight, soft and compressible fiber filler 19, as used with stuffed toys, is packed in the casing 15, surrounding the prongs 16A and 16B, and substantially covers the base member 16C.

Referring to an embodiment in FIG. 6, a seam 20 is formed in the casing 15 between the base member 16C and the filler 18. The base member 16C is preferably has a wider cross-sectional dimension than the seam, as shown in FIG. 6, so the base member 16C can pivot on the seam 20, and with respect to the support member 13. In addition, the seam 20 at least partially separates the filler 18 from the fiber filling 19 in the bottle holder 12 to prevent the weighted filler 18 from leaking into bottle holder 12 portion.

The operation of the apparatus can be seen in FIGS. 2–4, in which an infant 14 reclines in a seat 21. The apparatus 10 is placed on the infant 14 (not shown), so the support member 13 rests on the infant's 14 torso. The support member 13 conforms to the contours of the infant's 14 torso, so the apparatus is stabilized on the infant 14. The bottle 11 is positioned between the grasping members 16 at a height or elevation (FIG. 4) with respect to infant so the bottle can be tilted (FIG. 3) within the grasping members 12 to a feeding position. The grasping members apply sufficient frictional force to support the bottle 11 so the infant 14 or caregiver do not have to handle the bottle during feeding. In addition, the grasping members may be about 5–6 inches tall to position the bottle 11 for feeding.

As noted above, in an exemplary embodiment, the bottle holder 12 may be moveable with respect to the support member 13. The bottle 11 and grasping members 12A and 12B may be placed within the grasp of the infant 14, which can pull the bottle 11 or grasping members 12A and 12B towards his/her mouth. The infant 14 pulls the bottle 11 and the bottle holder 12 moves with respect to support member toward the infant 14. When the infant 14 is finished feeding, the infant 14 can push the bottle 11 or bottle holder 12, which moves with respect to the support member 13 away from the infant 14.

While the invention has been described in what is presently considered to be a preferred embodiment, many variations and modifications will become apparent to those skilled in the art. For example, the apparatus 10, including the bottle holder 12 and support member 13, may be two separable part and not formed as unitary piece, so the holder 12 may be detachable from the support member 13. Accordingly, it is intended that the invention not be limited to the specific illustrative embodiment but be interpreted within the full spirit and scope of the appended claims.

The invention claimed is:

1. An apparatus for holding a bottle while feeding an infant, comprising:

a weighted support member that rests on an infant's torso while feeding an infant, and is conformable to the infant's torso; and, a bottle holder, operatively connected to and extending upwardly from the support member, the bottle holder is moveable with respect to the support member to move a bottle toward or away from an infant's mouth;

said bottle including two prongs extending upwardly from the support member, spaced apart from another and moveable with respect to one another to support or remove a bottle from the bottle holder.

2. The apparatus of claim 1 wherein the bottle holder comprises an internal frame having two resilient members operatively connected to the support member that extend upward from the support member, the resilient members are moveable with respect to one another to support a bottle in the bottle holder, or remove a bottle from the bottle holder, and each of the frame members is encased within a cushion.

3. The apparatus of claim 1 wherein the weighted support member comprises a weighted, compressible filler held within a casing.

4. The apparatus of claim 3 wherein the bottle holder comprises an internal frame having two resilient members that are moveable with respect to one another to support a bottle in the bottle holder, or remove a bottle from the bottle holder, and each of the frame members is encased within a cushion and the frame members and cushion are operatively connected to the casing of the support member.

5. The apparatus of claim 1 wherein the bottle holder comprises an internal frame member has two resilient frame members spaced apart and moveable with respect to one another, and the frame members operatively supported on the weighted support member which includes a weighted, compressible filler, and the frame members and filler are enclosed within a casing, and padding surrounding the frame members within the casing.

6. The apparatus of claim 5 wherein the internal frame further comprises a transverse base member connected to a lower end of the resilient frame members and the casing having a between the base member and the filler material separating the filler material from the padding and enabling the bottle holder to pivot with respect to the support member.

7. An apparatus for holding a bottle while feeding an infant, comprising:

a weighted support member that rests on an infant's torso while feeding an infant, and is conformable to the infant's torso;

a bottle holder, operatively connected to and extending upwardly from the support member, the bottle holder is moveable with respect to the support member to move a bottle toward or away from an infant's mouth; and, the bottle holder and support member are integrally connected as a single unit; said the bottle holder and support member comprise a single casing encapsulating one or more internal components operably connected to one another; wherein the internal components include a weighted compressible filler in a bottom of the casing, and an internal frame member disposed on top of the filler and having two upwardly extending prongs for holding a bottle, and the internal frame member is moveable with respect to the filler.

8. The apparatus of claim 7 wherein the internal components further comprise a lightweight compressible filer within the casing covering the internal frame member.

9. The apparatus of claim 7 wherein the internal frame member comprises a transverse base member resting on the weighted, compressible filler, and the transverse base member is attached to a bottom end of each of the prongs, and the casing has a seam formed therein and disposed between the transverse base member and weighted filler, whereby the internal frame member pivots with respect to the seam.

10. An apparatus for feeding an infant, comprising:

a bottle for dispensing an edible fluid to an infant;

a weighted support member that rests on an infant's torso while feeding an infant, and is conformable to the infant's torso; and, a bottle holder, operatively connected to and extending upwardly from the support member, within said bottle is secured, and an elevation of the bottle is adjustable within the bottle holder and with respect to the infant to position the bottle for feeding; wherein the bottle holder includes two prongs extending upwardly from the support member, spaced apart from another and moveable with respect to one another to support or remove a bottle from the bottle holder.

11. The apparatus of claim 10 wherein the bottle holder is moveable with respect to the support member to move a bottle toward or away from an infant's mouth.

12. The apparatus of claim 10 wherein the bottle holder comprises an internal frame having two resilient members operatively connected to the support member that extend upward from the support member, the resilient members are moveable with respect to one another to support a bottle in the bottle holder, or remove a bottle from the bottle holder, and each of the frame members is encased within a cushion.

13. The apparatus of claim 10 wherein the weighted support member comprises a weighted, compressible filler held within a casing.

14. The apparatus of claim 13 wherein the bottle holder comprises an internal frame having two resilient members that are moveable with respect to one another to support a bottle in the bottle holder, or remove a bottle from the bottle holder, and each of the frame members is encased within a cushion and the frame members and cushion are operatively connected to the casing of the support member.

15. The apparatus of claim 10 wherein the bottle holder comprises an internal frame member has two resilient frame members spaced apart and moveable with respect to one another, and the frame members operatively supported on the weighted support member which includes a weighted, compressible filler, and the frame members and filler are enclosed within a casing, and padding surrounding the frame members within the casing.

16. The apparatus of claim 15 wherein the internal frame further comprises a transverse base member connected to a lower end of the resilient frame members and the casing having a between the base member and the filler material separating the filler material from the padding and enabling the bottle holder to pivot with respect to the support member.

* * * * *